US012378715B2

(12) United States Patent
Scherr

(10) Patent No.: US 12,378,715 B2
(45) Date of Patent: Aug. 5, 2025

(54) LAUNDRY MACHINE DOOR ASSEMBLY

(71) Applicant: Electrolux Appliances Aktiebolag, Stockholm (SE)

(72) Inventor: John Scherr, Morresville, NC (US)

(73) Assignee: Electrolux Appliances Aktiebolag, Stockholm (SE)

( * ) Notice: Subject to any disclaimer, the term of this patent is extended or adjusted under 35 U.S.C. 154(b) by 789 days.

(21) Appl. No.: 17/564,892

(22) Filed: Dec. 29, 2021

(65) Prior Publication Data

US 2023/0203743 A1 Jun. 29, 2023

(51) Int. Cl.
*D06F 58/20* (2006.01)
*D06F 58/02* (2006.01)

(52) U.S. Cl.
CPC ..... *D06F 58/20* (2013.01); *D06F 58/02* (2013.01)

(58) Field of Classification Search
CPC ..... D06F 58/20; D06F 39/14; D06F 37/10; E05C 1/004; E05C 1/08; E05C 1/085; E05C 1/12; E05C 1/14; E05C 1/145; E05C 1/16; E05C 1/166; Y10T 292/0969; Y10T 292/0971; Y10T 292/0972; Y10T 292/0974; Y10T 292/0975; Y10T 292/0994; Y10T 292/1015; Y10T 292/102
See application file for complete search history.

(56) References Cited

U.S. PATENT DOCUMENTS 1,140,553 A 5/1915 Whittier
1,191,679 A 7/1916 Dziegielewski
1,593,372 A 7/1926 Thompson
1,691,724 A 11/1928 Kruschka
1,724,116 A * 8/1929 Swearengin ..... E05C 1/10 292/145
2,317,277 A 4/1943 Knuth
2,453,935 A 11/1948 Quigley et al.
(Continued)

FOREIGN PATENT DOCUMENTS

CH 244295 A 9/1946
CN 101570925 A 11/2009
(Continued)

OTHER PUBLICATIONS

Ives-Glynn Johnson CL21A-US26D Ball Catch, 4-Way, 1 page, admitted prior art.

(Continued)

*Primary Examiner* — David J Laux
(74) *Attorney, Agent, or Firm* — Bradley Arant Boult Cummings LLP

(57) ABSTRACT

A laundry machine comprising a housing, a drum in the housing, a door movable to close and open access to the drum, and a door latch assembly. The door latch assembly has a bolt that is movable between first and second bolt positions, with first position on a first travel path of the door, and the second position on a second travel path of the door. The door has a bolt handle connected to the bolt to move the bolt between the bolt positions. A catch is mounted within the first travel path and not within the second travel path, and configured to engage the bolt to exert an opening force opposing movement of the bolt along the first travel path upon movement of the door from the closed door position towards the open door position.

22 Claims, 9 Drawing Sheets

(56) References Cited

U.S. PATENT DOCUMENTS

| | | | | |
|---|---|---|---|---|
| 2,507,511 | A | 5/1950 | Freidag et al. | |
| 2,677,952 | A | 5/1954 | Stue | |
| 2,857,191 | A | 10/1958 | Buchholtz | |
| 2,967,001 | A * | 1/1961 | Landon | D06F 37/10 292/341.12 |
| 3,287,043 | A | 11/1966 | Delhase | |
| 3,480,315 | A * | 11/1969 | Wolverton | D06F 37/10 68/139 |
| 3,924,085 | A * | 12/1975 | Stone | D06F 37/42 200/61.81 |
| 4,635,977 | A * | 1/1987 | Yamada | E05B 65/0053 292/206 |
| 6,568,719 | B2 | 5/2003 | Buscella | |
| 8,104,848 | B2 | 1/2012 | Yoon | |
| 8,118,332 | B2 | 2/2012 | Morgan et al. | |
| 8,246,089 | B2 | 8/2012 | Mueller et al. | |
| 9,120,577 | B1 | 9/2015 | Baic | |
| 9,372,001 | B2 | 6/2016 | Gayle et al. | |
| 9,410,349 | B2 | 8/2016 | Hapke et al. | |
| 9,415,876 | B1 | 8/2016 | Baic | |
| 9,745,785 | B2 | 8/2017 | Header | |
| 10,023,992 | B2 | 7/2018 | Krieger | |
| 2004/0129035 | A1* | 7/2004 | Chang | D06F 37/304 68/23 R |
| 2008/0231061 | A1* | 9/2008 | Rocchitelli | D06F 37/42 292/303 |
| 2009/0288346 | A1* | 11/2009 | Esser | E05B 47/0673 292/65 |
| 2010/0050345 | A1 | 3/2010 | Kim et al. | |
| 2013/0140832 | A1* | 6/2013 | Do | E05B 65/0817 292/145 |
| 2016/0326686 | A1* | 11/2016 | Jo | D06F 37/28 |
| 2016/0326687 | A1* | 11/2016 | Jo | D06F 39/14 |
| 2018/0002859 | A1 | 1/2018 | Hombroek et al. | |
| 2018/0202205 | A1 | 7/2018 | Pychtin | |
| 2019/0063123 | A1* | 2/2019 | Ham | E05C 7/005 |
| 2019/0178014 | A1 | 6/2019 | Gerasimov et al. | |

FOREIGN PATENT DOCUMENTS

| | | | |
|---|---|---|---|
| CN | 102199854 | A | 9/2011 |
| CN | 102199856 | A | 9/2011 |
| CN | 105155202 | A | 12/2015 |
| CN | 105177922 | A | 12/2015 |
| CN | 106574419 | A | 4/2017 |
| CN | 107002335 | A | 8/2017 |
| CN | 105088684 | B | 4/2018 |
| CN | 105177923 | B | 4/2018 |
| CN | 109208258 | A | 1/2019 |
| DE | 102006029202 | A1 | 12/2007 |
| EP | 1688529 | A1 | 8/2006 |
| EP | 2194181 | A2 | 6/2010 |
| EP | 2602380 | A1 | 6/2013 |
| EP | 2959819 | A1 | 12/2015 |
| FR | 524921 | A | 9/1921 |
| GB | 18394 | | 1/1914 |
| GB | 418675 | | 10/1934 |
| GB | 607743 | | 9/1948 |
| GB | 990182 | | 4/1965 |
| JP | 2014210123 | A | 11/2014 |
| WO | 2015197109 | A1 | 12/2015 |
| WO | 2016102011 | A1 | 6/2016 |
| WO | 2017033477 | A1 | 3/2017 |
| WO | 2018001072 | A1 | 1/2018 |

OTHER PUBLICATIONS

TundraFMP CHG-M22-2430—M22 Heavy Duty 4-Way Door Catch, 1 page, admitted prior art.

Chinese Office Action for Chinese Application No. 201980092867.5, with English translation, dated Mar. 14, 2023, 24 pages.

International Search Report and Written Opinion for International Application No. PCT/EP2019/054857, dated Sep. 18, 2019, 10 pages.

International Search Report and Written Opinion for International Application No. PCT/EP2019/054858, dated Nov. 7, 2019, 8 pages.

Chinese Office Action for Chinese Application No. 201980093024.7, dated Apr. 6, 2023 with translation, 22 pages.

Korean Request for the Submission of an Opinion for Korean Application No. 10-2021-7027740, dated Jul. 15, 2023 with translation, 11 pages.

* cited by examiner

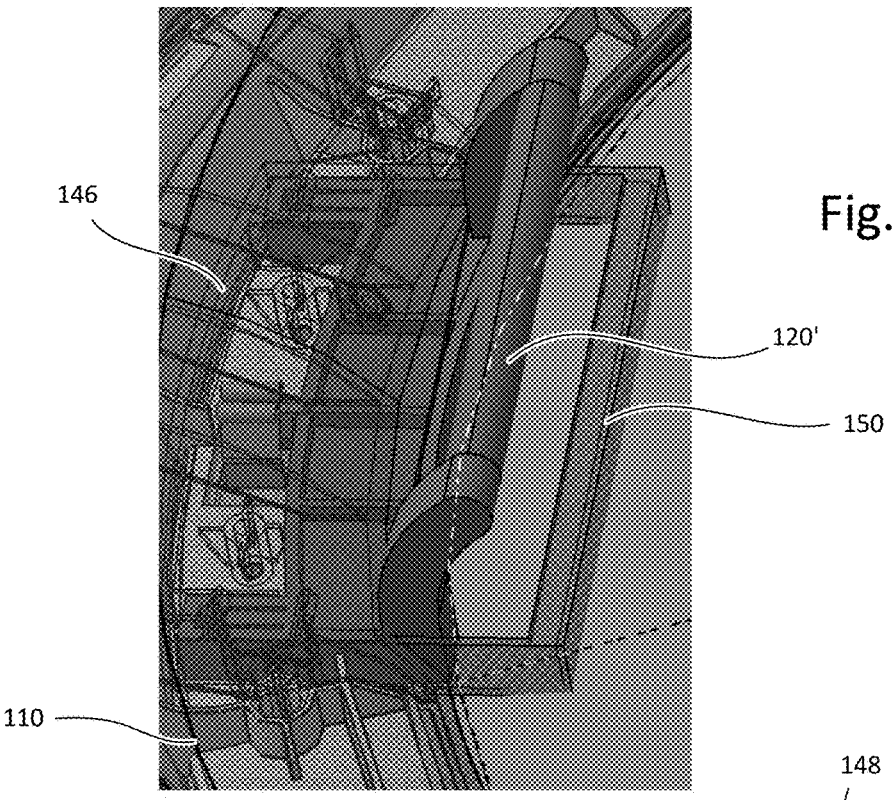
Fig. 4
Fig. 5
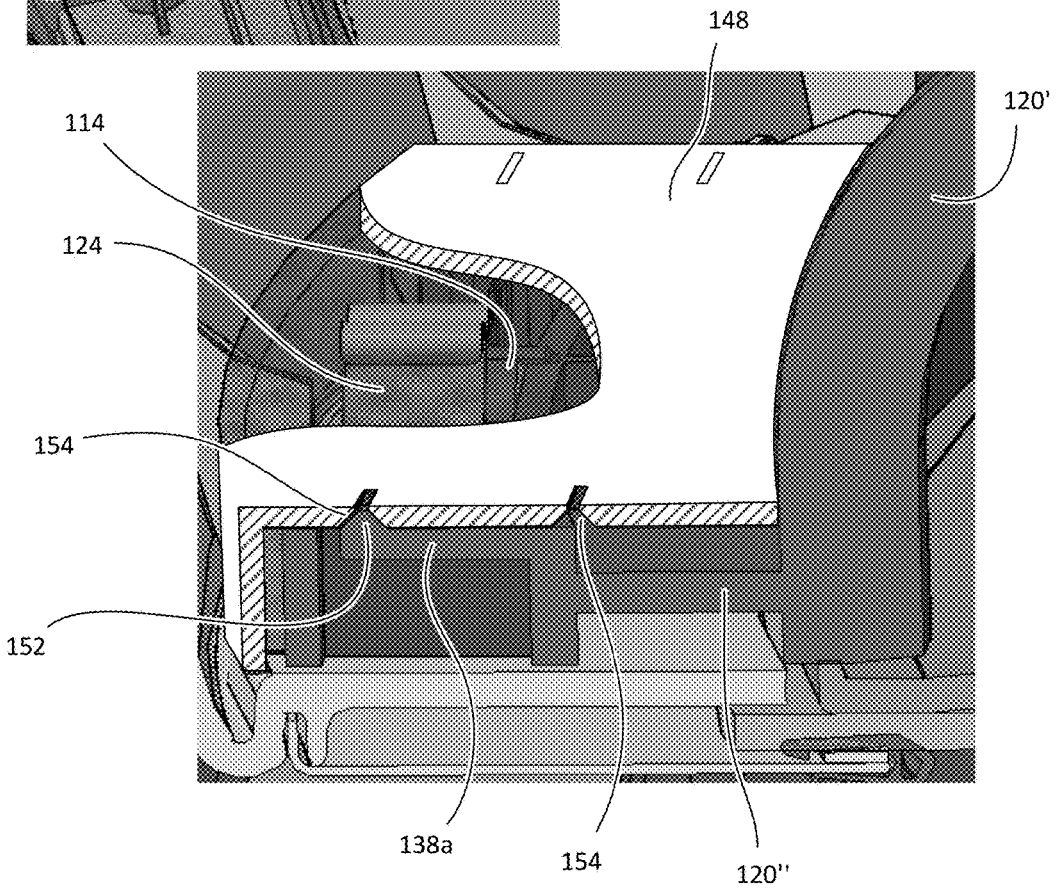

LAUNDRY MACHINE DOOR ASSEMBLY

TECHNICAL FIELD

This application is directed to laundry washer and dryer door assemblies.

BACKGROUND

Laundry machines, particularly washers and dryers (and combination washer/dryers), are often configured with a drum access door on the front face of the machine. Such doors typically are designed to react to internal loads generated by normal operation, but release when the load exceeds a predetermined threshold. In particular, the laundry load can contact the door as the drum rotates during operation of the machine, and the door must resist forces caused by such contact to prevent the laundry from forcing the door open as the machine operates. However, a person such as a playing child might climb into the laundry machine drum, in which case the person preferably can push the door open from the inside to escape the drum. Thus, a laundry machine door might be designed to resist relatively low loads (e.g., 9 pounds or less) caused by normal operation, but release upon experiencing a higher load (e.g., 15 pounds or more) as might be generated in an emergency situation.

The design of a laundry machine door is further complicated if one takes into consideration the desire to make the door operable from the outside by persons who are not able to generate much force to open or close the door. For example, the Americans With Disabilities Act (ADA) suggests that a door should be openable from the outside by applying less than 5 pounds of force. It has been found that this additional functionality can be difficult to obtain, and a door that meets the internal load requirements described above oftentimes is not able to satisfy the ADA's suggested opening force threshold.

This description of the background is provided to assist with an understanding of the following explanations of exemplary embodiments, and is not an admission that any or all of this background information is necessarily prior art.

SUMMARY

In a first aspect, there is provided a laundry machine having a housing having an access opening, a drum mounted within the housing and configured to rotate about a generally horizontal rotation axis, the drum comprising an open end located along the rotation axis and facing the access opening, a door rotatably connected to the housing adjacent to the access opening, the door being movable between a closed door position in which the door closes the access opening, and an open door position in which the door does not close the access opening, and a door latch assembly. The door latch assembly has: a bolt movable between a first bolt position and a second bolt position, wherein the first bolt position is located on a first travel path defined by movement of the door between the closed door position and the open door position, and the second bolt position is located on a second travel path defined by movement of the door between the closed door position and the open door position, a bolt handle having a grip portion that is accessible when the door is in the closed door position, the bolt handle being operatively connected to the bolt and configured to move the bolt from the first bolt position to the second bolt position, and a catch mounted within the first travel path and not within the second travel path, the catch being configured to engage the bolt when the door is in the closed door position and the bolt is in the first bolt position, wherein the catch and bolt are is configured to exert an opening force opposing movement of the bolt along the first travel path upon movement of the door from the closed door position towards the open door position. The bolt and the bolt handle are mounted to one of the door and the housing, and the catch is mounted to the other of the door and the housing.

The laundry machine may have a forced-air drying system.

The bolt may be mounted to move along a linear path between the first bolt position and the second bolt position.

The linear path may extend from the first bolt position towards a rotation axis of the door.

The bolt may be integrally formed with the bolt handle.

The bolt may be connected to the bolt handle by an intermediate linkage.

The bolt may be mounted to the door to move along a semicircular path about a bolt rotation axis between the first bolt position and the second bolt position.

The bolt rotation axis may be parallel to a rotation axis of the door.

The catch may be configured to exert a closing force opposing movement of the bolt along the first travel path upon movement of the door from the open door position to the closed door position.

The closing force may be equal to the opening force.

The bolt may be operatively connected to the door or the housing by a resilient member configured to exert an unlatching force opposing movement of the bolt from the first bolt position to the second bolt position.

The resilient member may comprise a spring positioned between the door or the housing and at least one of the bolt and the bolt handle.

The spring may be integrally formed with the bolt.

The unlatching force may be less than the opening force.

The unlatching force may be less than 5 pounds force, and the opening force may be between 9 pounds force and 15 pounds force.

The bolt may have an entry face directed towards the closed door position and an exit face directed towards the open door position, and the catch may have opposed leaf springs configured to be spread apart by the entry face upon movement of the door approaching the door closed position with the bolt in the first bolt position, and to move together to at least partially surround the exit face upon the door reaching the closed position with the bolt in the first bolt position.

The entry face may have an entry wedge that tapers towards the closed door position to an entry wedge tip, and the exit face may have an exit wedge that tapers towards the open door position to an exit wedge tip.

The entry wedge may taper at a first angle, the exit wedge may taper at a second angle, with the first angle being equal to the second angle.

BRIEF DESCRIPTION OF THE DRAWINGS

Embodiments of inventions will now be described, strictly by way of example, with reference to the accompanying drawings, in which:

FIG. 4 illustrates a door latch assembly operatively connected to a laundry machine door.

FIG. 5 illustrates the door latch assembly of FIG. 4 with the slider housing and portions of the bolt handle in cutaway view, as configured with the bolt in the first bolt position.

DESCRIPTION OF EXEMPLARY EMBODIMENTS

Figure 1:
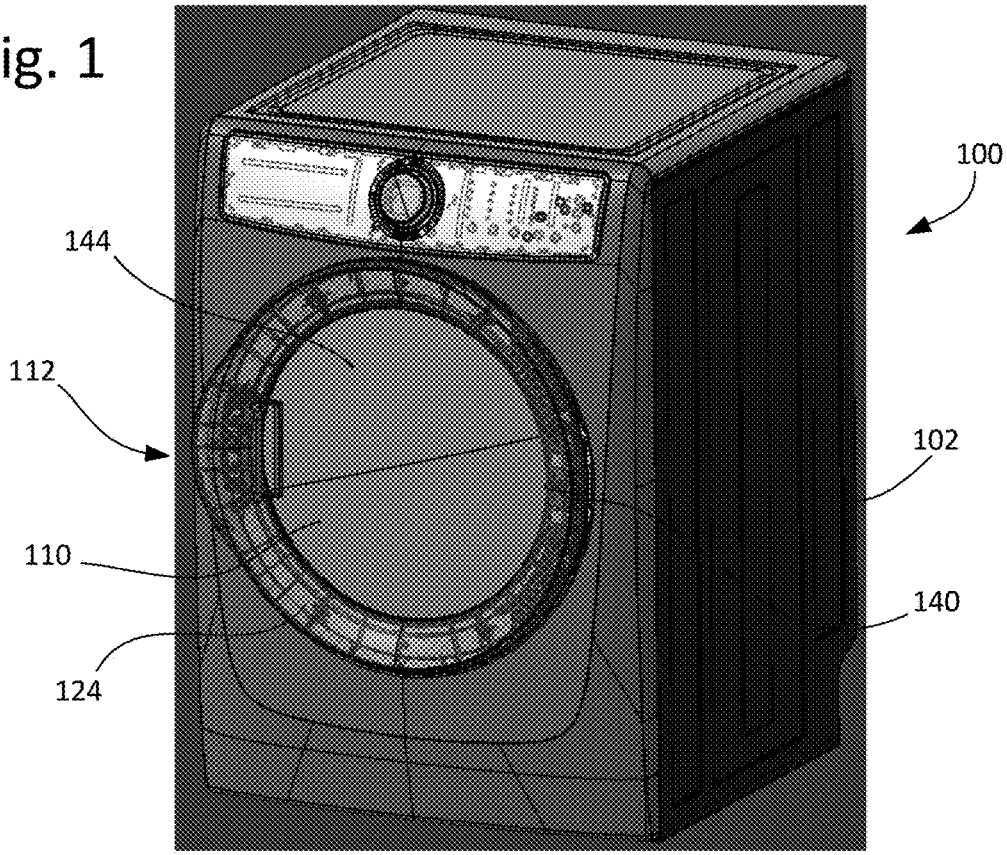
FIG. 1 illustrates an embodiment of a laundry machine with a door in the closed position.
Figure 2:
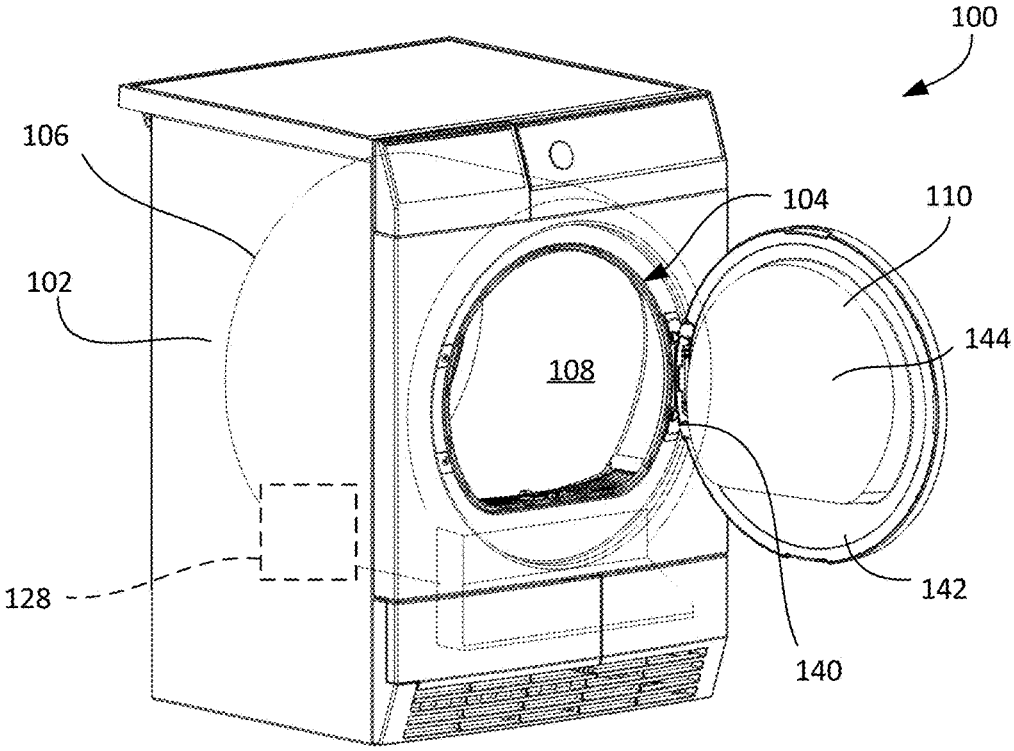
FIG. 2 illustrates an embodiment of a laundry dryer with the door in the open position.

FIGS. 1 and 2 illustrate a laundry machine 100 according to exemplary embodiments. The laundry machine includes a housing 102 that defines an access opening 104, and a drum 106 mounted within the housing 102. The drum 106 is mounted to the housing 102 by pulleys, rollers, axles or the like, such that it can rotate relative to the housing 102 about a generally horizontal axis (i.e., less than 45°, and more typically less than 10°, relative to a vertical gravitational axis when the machine 100 is positioned for use). The drum 106 has an open end 108 located along the rotation axis and facing the access opening 104, such that laundry items can be passed into the drum 106 via the access opening 104 and open end 108 of the drum.

The laundry machine 100 has a door 110, which is rotatably connected to the housing 102 adjacent to the access opening 104. The door 110 is pivotably mounted to the housing 102 by a hinge 140 or the like, such that the door 110 is movable between a closed door position (shown in FIG. 1) in which the door 110 closes the access opening 104, and an open door position (shown in FIG. 2) in which the door 110 does not close the access opening 104. The door may include a structural frame 142 that surrounds a transparent window 144, or other features as known in the art. The laundry machine 100 may comprise a washing machine (i.e., a machine that uses water or other liquids to cleanse the laundry), a drying machine, or a combination washer/dryer. In the shown example, the laundry machine 100 is a dryer having a forced-air drying system 128 (shown schematically) including one or more heaters or heat pumps configured to generate heated air, and one or more fans configured to circulate the heated air through the drum.

Figure 3A:
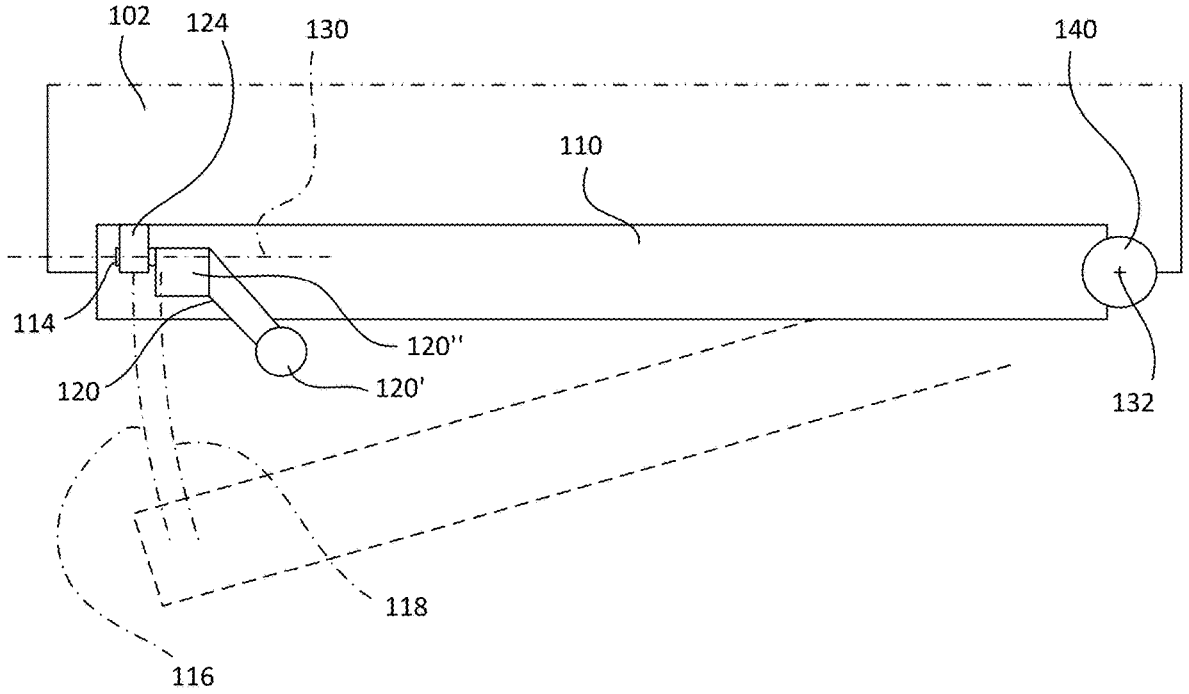
FIG. 3A schematically illustrates a top view of a laundry machine with the door in the closed position and the door latch assembly positioned with the bolt in the first bolt position.
Figure 3B:
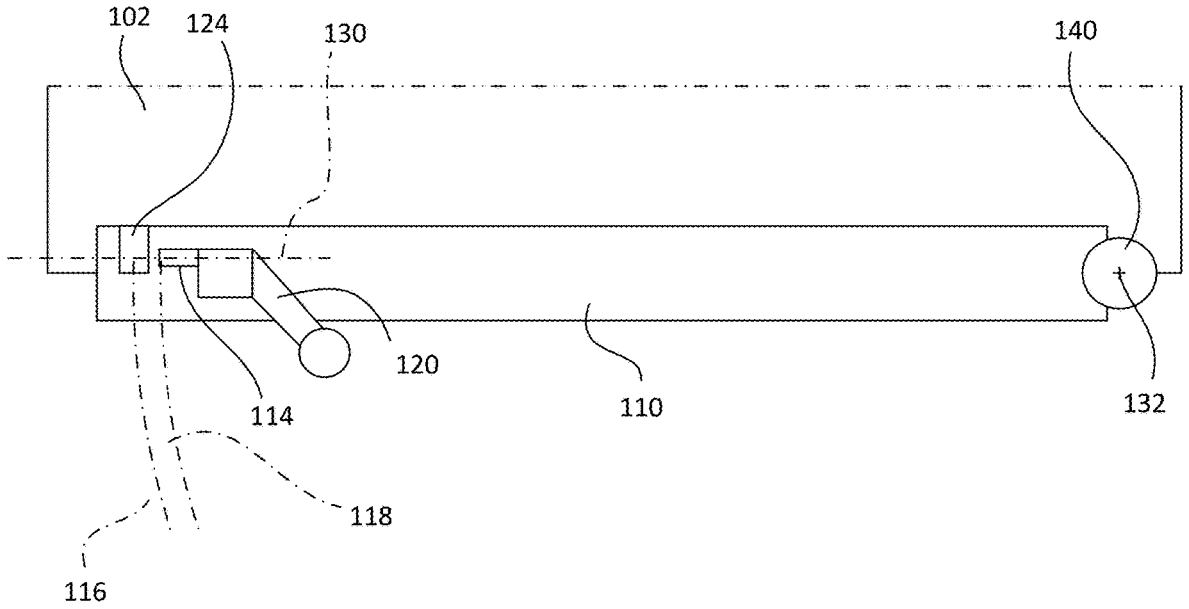
FIG. 3B schematically illustrates a top view of the laundry machine of FIG. 3A with the door in the open position with the door latch assembly positioned with the bolt in the second bolt position.

A door latch assembly 112 is provided to selectively hold the door 110 in the closed position. The door latch assembly 112 generally includes a bolt 114 mounted to the door 110, a bolt handle 120 mounted to the door, and a catch 124 mounted to the housing 102. Referring now also to FIGS. 3A and 3B, the bolt 114 is movable, by operating the bolt handle 120, between a first bolt position such as shown in FIG. 3A, and a second bolt position such as shown in FIG. 3B. In the first bolt position, the bolt 114 is located on a first travel path 116 that is defined by movement of the door 110 between the closed door position (shown in solid lines) and an open door position (shown in broken lines). In the second bolt position, the bolt 114 is located on a second travel path 118 defined by movement of the door 110 between the closed door position and the open door position. It will be understood that the first travel path 116 and the second travel path 118 are paths defined by the bolt 114, with the bolt in the respective bolt position, as the door 110 moves (i.e., the bolt 114 traces the first travel path 116 when the door 110 is moved between the open and closed positions with the bolt 114 in the first bolt position, and the bolt 114 traces the second travel path 118 when the door 110 is moved between the open and close positions with the bolt 114 in the second bolt position).

In the shown example, the first travel path 116 and second travel path 118 are spaced radially with respect to a rotation axis 132 of the door, with the second travel path 118 being closest to the rotation axis 132. However, this arrangement is not strictly required. For example, the first travel path 116 may be closer to the rotation axis 132 than the second travel path 118, or the first travel path 116 and second travel path 118 may be equidistant in the radial direction to the rotation axis 132.

The bolt handle 120 is mounted to the door 110, and at least a grip portion 120' of the bolt handle 120 extends from an exterior face 122 of the door when the door 110 is in the closed door position. Thus, a user can contact the grip portion 102' to operate the bolt handle 120, even when the door 110 is closed. The bolt handle 120 is operatively connected to the bolt 114 and configured to move the bolt 114 from the first bolt position to the second bolt position, such as shown in FIGS. 3A and 3B.

The catch 124 is mounted to the housing 102, and positioned within the first travel path 116, but not within the second travel path 118. The catch 124 is configured to engage the bolt 114 when the door 110 is in the closed door position and the bolt 114 is in the first bolt position, and the bolt 114 and the catch 124 are configured to exert an opening force opposing movement of the bolt 114 along the first travel path 116 upon movement of the door 110 from the closed door position towards the open door position. When the bolt 114 is in the first bolt position, the catch 124 resists movement of the bolt 114, and thus the door 110, away from the closed door position. However, when the bolt 114 is in the second bolt position, the bolt 114 does not interact with the catch 124, and so the bolt 114 and door 110 can be moved freely away from the closed position. This arrangement allows selective and independent control of the opening force required to overcome the catch 124 and open the door 110 when the bolt 114 is in the first bolt position, and an unlatching force necessary to move the bolt 114 from the first bolt position to the second bolt position to thereby negate the need to apply the opening force to open the door 110.

Figure 6:
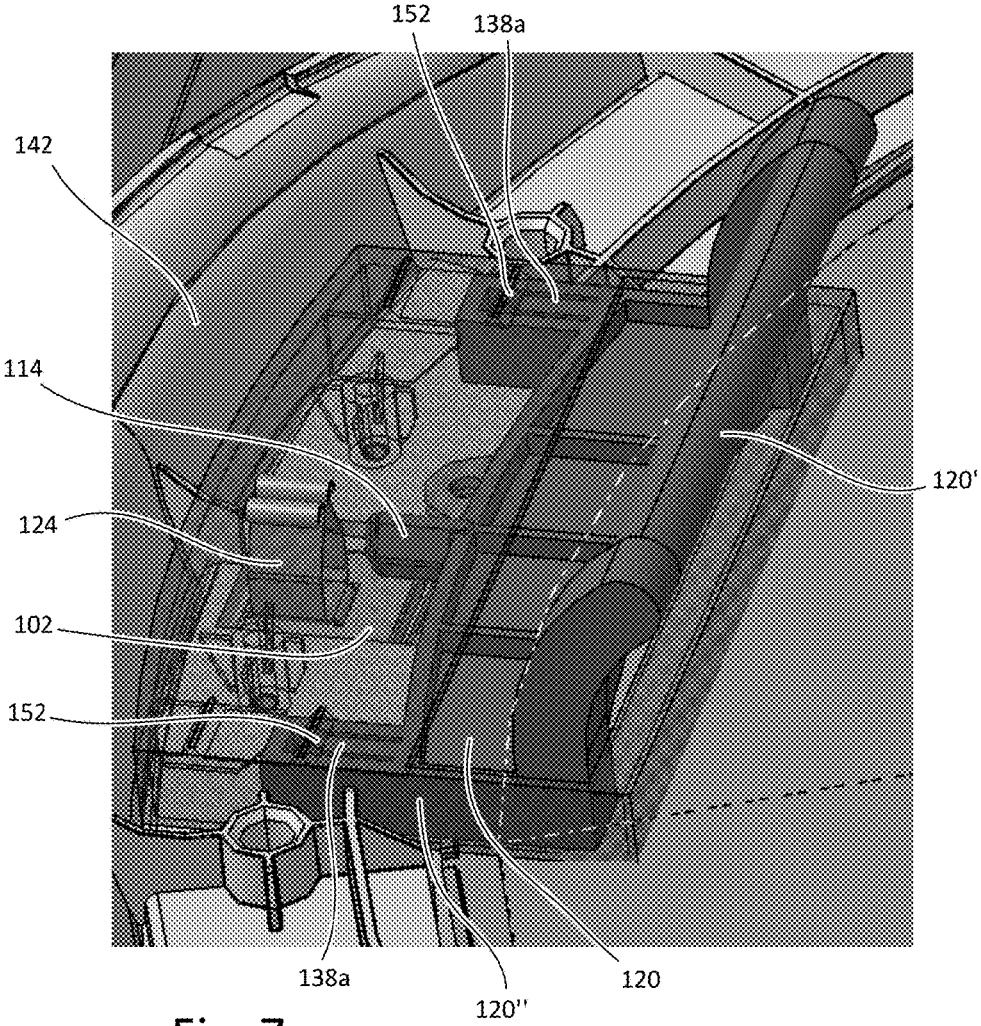
FIG. 6 illustrates the door latch assembly of FIG. 4, as configured with the bolt in the second bolt position and the slider housing removed.

Details of an exemplary door latch assembly 112 are shown in FIGS. 4-6. In this case, the bolt 114 and bolt handle 120 are made as a unitary part, such as by forming them both in a single injection molding process, but this is not strictly required. The handle 120 includes a grip portion 120' that is accessible to the user when the door 110 is closed, and a slider portion 120" that may be fully or partially concealed under a decorative trim 146 or within the door frame 142. The slider portion 120" is captured in place between a slider housing 148 and the door frame 142, which together form a space in which the slider portion 120" can move back and forth along a linear path 130 between the first bolt position as shown in FIGS. 4 and 5, and the second bolt position as shown in FIG. 6. The slider housing 148 may include travel stops, such as a rear retaining wall 150, to prevent excessive movement of the slider portion 120".

The linear path 130 may be oriented in any direction. In the example of FIG. 3-7, the linear path 130 extends from the first bolt position towards the rotation axis 132 of the door. In this case, the grip portion 120' is pushed towards the door rotation axis 132 to release the bolt 114 from the catch 124. In other cases, the linear path 130 may be oriented to be parallel with the door rotation axis 132, or at other angles.

The catch 124 is positioned to protrude into the slider housing 148 at a location where it surrounds the bolt 114 when the bolt is in the first bolt position. However, sliding the bolt 114 to the second bolt position removes the bolt 114 from the confines of the catch 124.

The door latch assembly 112 may include features to control or influence the position or movement of the bolt 114 along the linear path 130. For example, the bolt handle 120 may include one or more resilient members, such as springs or blocks of resilient material (e.g., elastomeric foam), that generate a force that must be overcome to move the bolt 114.

One example of a resilient member is shown in FIGS. 4-6 as a pair of cantilevered springs 138*a*. Each spring 138*a* extends from the slider portion 120" of the bolt handle 120, and includes a protrusion 152 that extends perpendicular to the linear path 130. The protrusion 152 engages one or more detents 154 formed in the door 110 (e.g., in the slider housing 148) when the bolt handle 120 is at one or more respective locations along the linear path 130, and thus operatively connects the bolt 114 to the door 110. In this case, a respective first detent 154*a* is positioned to receive each spring's protrusion 152 when the bolt 114 is in the first bolt position, and a respective second detent 154*b* is positioned to receive each spring's protrusion 152 when the bolt 114 is in the second bolt position. Each cantilevered spring 138*a* generates a restoring force that drives the respective protrusion 152 into the respective detent 154*a*, 154*b*, and this restoring force must be overcome to release the protrusions 152 from the detents 154*a*, 154*b*.

The arrangement of FIGS. 4-6 provides an unlatching force to hold the bolt 114 in the first bolt position. The unlatching force must be overcome to move the bolt 114 out of the first bolt position and into the second bolt position. The magnitude of the unlatching force may be regulated by selecting the shapes and sizes of the protrusion 152 and detent 154*a*, and by selecting the restoring force of the cantilevered spring (e.g., by selecting appropriate dimensions or material properties). The magnitude of the unlatching force is independent of the magnitude of the opening force required to pull the door open when the bolt 114 is in the first bolt position. Thus, the door latch assembly 112 may be configured to have a relatively high opening force, such as a magnitude between 9 pounds force and 15 pounds force, and a relatively low unlatching force, such as less than 5 pounds force.

The shape, position and construction of the springs 138*a* may be modified in various ways while still providing an unlatching force that is independent of the door opening force. For example, a single spring 138*a* may be used or the locations of the springs 138*a* may be changed. As another example, each spring 138*a* may be formed as a separate part, such as a ribbon of spring steel bent to form a protrusion 152, that is attached to the bolt handle 120 or bolt 114. The positions of the protrusions 152 and detents 154 also may be reversed (e.g., protrusions 152 on the door 110 and detents 154 on the bolt handle 120). The springs 138*a* also may be replaced by other resilient members, such as a compression spring located between the slider portion 120" and the rear retaining wall 150. In such cases, the protrusions 152 and detents 154 may be omitted. Other alternatives and variations will be apparent to persons of ordinary skill in the art in view of the present disclosure.

The bolt 114 and catch 124 may have any construction suitable to generate an opening force to resist accidental opening of the door 110 caused by normal internal operating forces (e.g., laundry movement), while allowing the door 110 to open upon applying a sufficiently large force to overcome the opening force by pushing from inside the door 110, or pulling from the outside the door 110.

Figure 7:
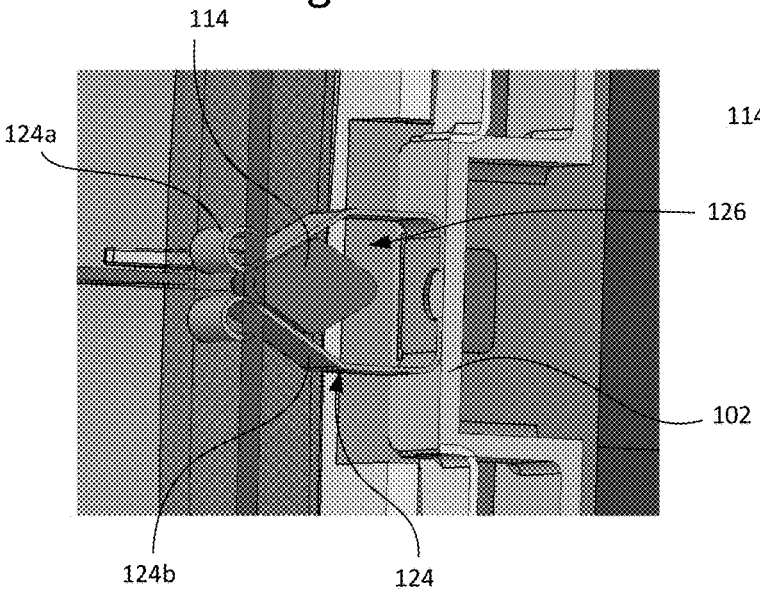
FIG. 7 illustrates the bolt and catch of the door latch assembly of FIG. 4 in detailed cutaway view.
Figure 8:
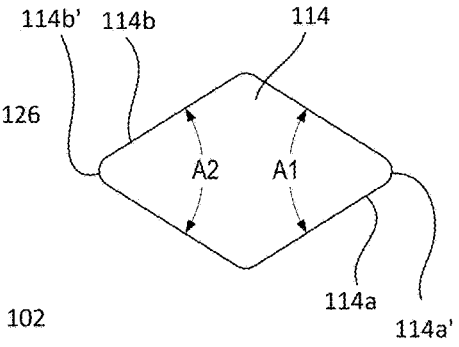
FIG. 8 illustrates the bolt of the door latch assembly of FIG. 4 in cross-sectional view.

Details of an exemplary bolt 114 and catch 124 are shown in FIGS. 6 and 7. Here, the catch 124 is formed by a pair of opposed leaf springs 124*a*, 124*b* that extend along the first travel path 116 and are curved towards each other to form the catch receptacle 126. The bolt 114 has a rhombus shape, as viewed perpendicular to the first travel path 116, with a wedge-shaped entry face 114*a* directed towards the closed door position, and a wedge-shaped exit face 114*b* directed towards the open door position. The entry face 114*a* is configured to spread apart the leaf springs 124*a*, 124*b* upon moving the door 110 to the closed position while the bolt 114 is in the first bolt position. When the door 110 reaches the fully closed position while the bolt 114 is in the first bolt position, the leaf springs 124*a*, 124*b* move towards each other to at least partially surround the exit face 114*b*. Moving the door 110 from the closed position towards the open position causes the exit face 114*b* of the bolt 114 to contact and spread apart the leaf springs 124*a,* 124*b*.

In this embodiment, the shapes and material properties of the leaf springs 124*a,* 124*b* and entry face 114*b* affect the magnitude of the force required to close the door with the bolt 114 in the first bolt position, and the shapes and material properties of the leaf springs 124*a,* 124*b* and exit face 114*b* affect the magnitude of the opening force with the bolt 114 in the first bolt position. The closing force and opening force may be selected to be the same or different by choosing appropriate shapes for the leaf springs 124*a,* 124*b* and bolt 114. For example, in the shown embodiment, the wedge-shaped entry face 114*a* tapers at a first angle A1 to an entry wedge tip 114*a*', and the wedge-shaped exit face 114*b* tapers at a second angle A1 to an exit wedge tip 114*b*'. The leaf springs 124*a,* 124*b* have similar tapered regions against which the entry face 114*a* and exit face 114*b* press to spread the leaf springs 124*a,* 124*b* apart. The first angle A1 and the second angle A2 (and the corresponding faces of the leaf springs 124*a,* 124*b*) may be equal to each other, in which case the opening force will be approximately equal to the closing force. Alternatively, the angles A1, A2 (or leaf springs faces) may have different angles to provide greater or lesser leverage to force the leaf springs 124*a,* 124*b* apart, leading to different opening and closing forces.

The bolt 114 and catch 124 may be configured to generate a preload force to hold the door 110 when the door 110 is in the closed position. For example, the exit face 114*b* may be dimensioned such it holds the leaf springs 124*a,* 124*b* spread slightly apart to generate a restoring force against the exit face 114*b,* even when the door 110 is fully closed. Such preload force helps prevent the door 110 from being able to open slightly before requiring the opening force to be overcome to fully open the door. The preload force can also generate friction to resist movement of the bolt 114 to the second bolt position. The bolt 114 also may include features to ensure that the preload force is generated when the door 110 is closed with the bolt 114 in the second bolt position, and then moved to the first bolt position to lock the door 110. For example, the bolt 114 may have a tapered tip 114' that is shaped to push apart the leaf springs 124*a,* 124*b* as the bolt 114 is moved from the second bolt position to the first bolt position while the door 110 is closed. This tapered tip 114' also ensures that the side edges of the leaf springs 124*a,* 124*b* do not block the bolt 114 from being moved from the second bolt position to the first bolt position when the door 110 is closed.

Other embodiments may use other bolts 114 and catches 124. For example, the bolt 114 may have a round shape, rather than a rhombus shape. As another example, the catch 124 may be formed by rigid arms that are connected to the housing 102 by resilient springs that bias the arms together. In other cases, the catch 124 may comprise a single cantilevered arm with a protrusion or hook that holds the bolt 114. The catch 124 also may comprise a rigid pin while the bolt 114 comprises a pair of resilient springs that snap over the pin when the door 110 is opened or closed with the bolt 114 in the first bolt position. In this case, the springs that form the bolt 114 may be oriented such that the pin slides between them as the bolt is moved from the second bolt positon to the first bolt position, in a manner essentially the same as how the bolt 114 of FIGS. 4-8 slides between the springs forming the catch 124. Other alternatives and variations of a bolt 114 and catch 124 will be apparent to persons of ordinary skill in the art in view of the present disclosure.

Figure 9A:
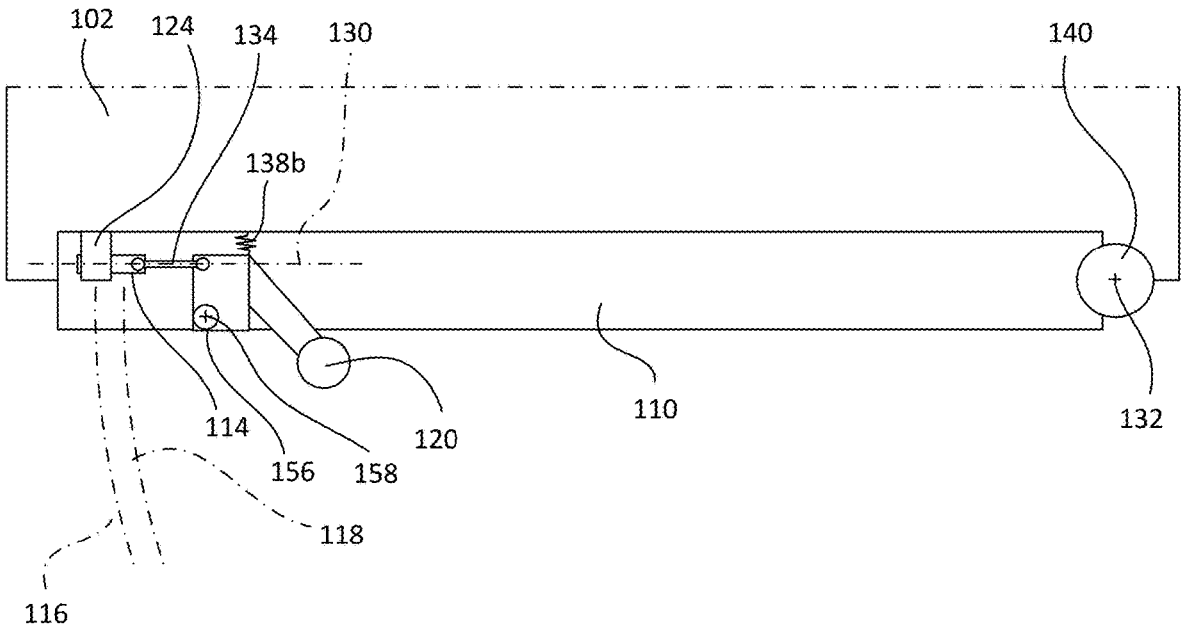
FIG. 9A schematically illustrates a top view of another laundry machine with the door in the closed position and the door latch assembly positioned with the bolt in the first bolt position.
Figure 9B:
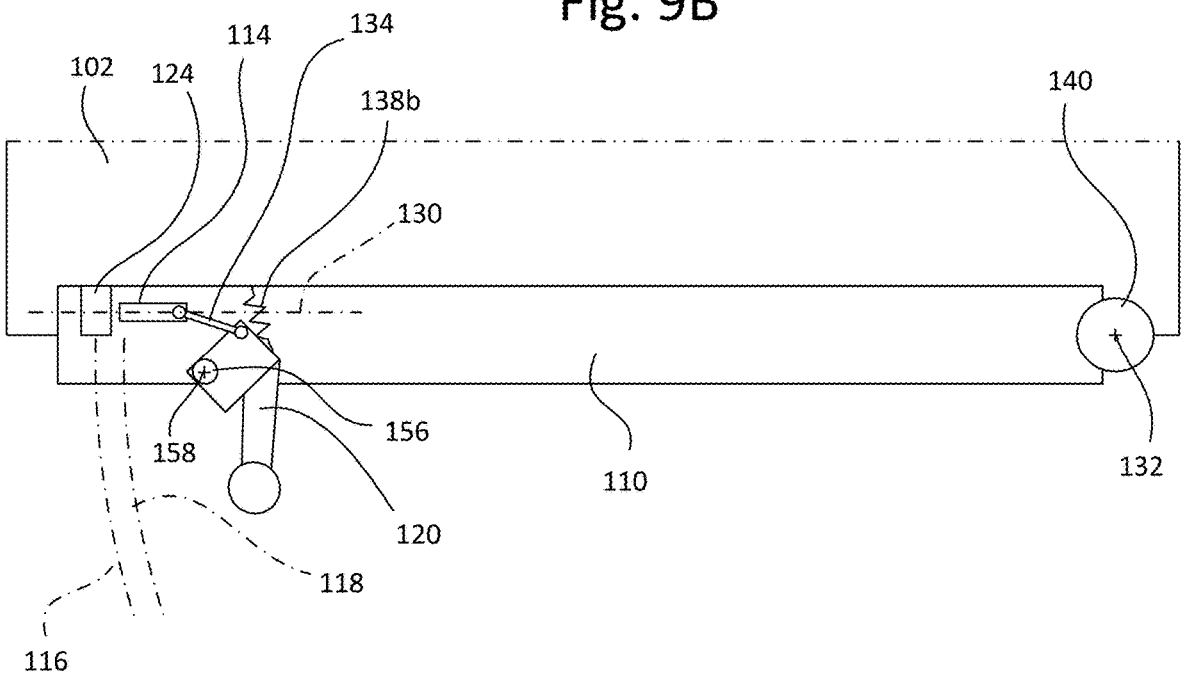
FIG. 9B schematically illustrates a top view of the laundry machine of FIG. 9A with the door in the open position with the door latch assembly positioned with the bolt in the second bolt position.

FIGS. 9A and 9B show another alternative embodiment of a door latch assembly 112. In this case, the bolt handle 120 is pivotally connected to the door 110 by a bolt handle hinge 156, such that the bolt handle 120 rotates relative to the door 110 about a bolt handle rotation axis 158, which may or may not be parallel to the door rotation axis 132. The bolt handle 120 is operatively connected to the bolt 114 by an intermediate linkage 134, such that rotation of the bolt handle 120 causes translational movement of the bolt 114 along the linear path 130. In this case, the intermediate linkage 134 comprises a single link that is pivotally connected at one end to the bolt handle 120 and at the other end to the bolt 114. However, other intermediate linkages may have multiple links, cam-and-follower linkages, sliding links (pin in slot or lost motion), and so on. The intermediate linkage also may comprise a rack and pinion arrangement, such as by providing a pinion gear on the bolt handle 120 and a toothed rack on the bolt 114. Other alternatives and variations will be apparent to persons of ordinary skill in the art in view of the present disclosure.

In the embodiment of FIGS. 9A and 9B, the bolt 114 is slidingly mounted to the door 110 (e.g., by being captured in a slider housing 148 or mounted on a track or tracks), and also operatively connected to the door 110 by a resilient member to generate an unlatching force that must be overcome to move the bolt 114 from the first bolt position to the second bolt position. The resilient member may comprise a cantilevered spring 138*a* that engages detents 154, such as described above, or other suitable structures. In this case the resilient member is a tension spring 138*b* that connects the door 110 to the bolt handle 120, and generates a restoring force to pull the bolt handle 120 into a position corresponding to the first bolt position. Thus, the tension spring 138*b* is operatively connected to the bolt 114 to generate an unlatching force that biases the bolt 114 to the first bolt position.

Figure 10A:
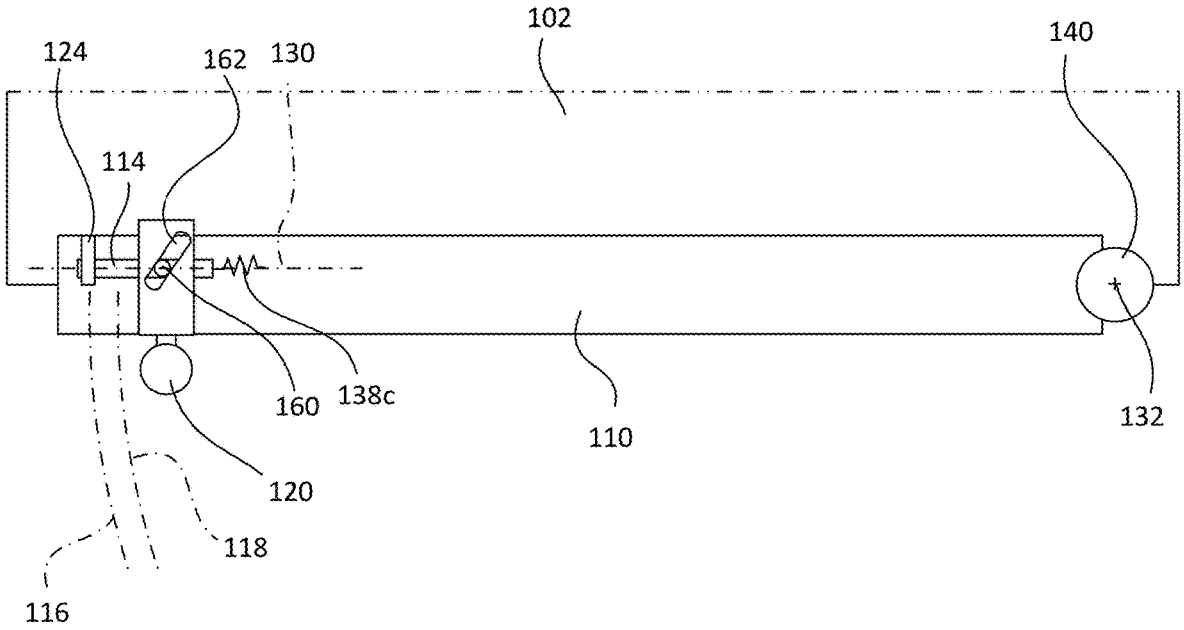
FIG. 10A schematically illustrates a top view of another laundry machine with the door in the closed position and the door latch assembly positioned with the bolt in the first bolt position.
Figure 10B:
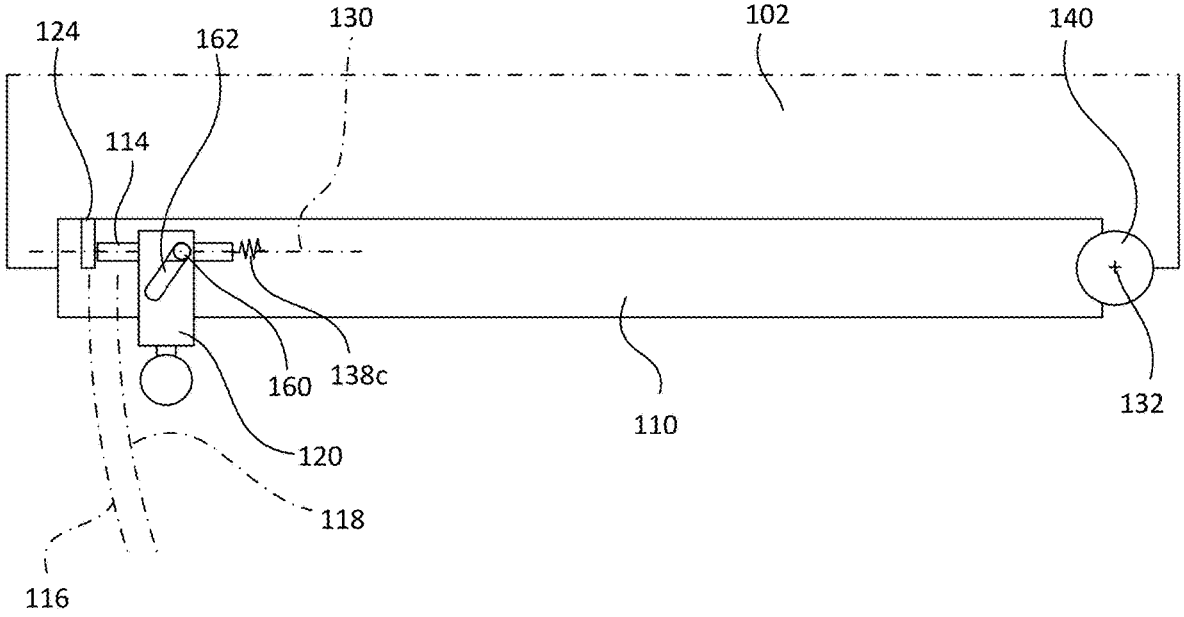
FIG. 10B schematically illustrates a top view of the laundry machine of FIG. 10A with the door in the open position with the door latch assembly positioned with the bolt in the second bolt position.

FIGS. 10A and 10B show another embodiment of a door latch assembly 112. Here, the bolt 114 is slidingly mounted to the door to move along a linear path 130, and the bolt handle 120 is slidingly mounted to the door to move at an angle (e.g., perpendicular) to the linear path 130. In this case, the bolt handle 120 is operatively connected to the bolt 114 by an intermediate linkage comprising a pin 160 and slot 162 arrangement. The pin 160 is fixed to the bolt 114, and fits within a slot 162 formed in the bolt handle 120. Movement of the bolt handle 120 causes the slot 162 to act as a cam to drive the pin 160 and thus move the bolt 114. A compression spring 138*c* is provided to generate an unlatching force to bias the bolt 114 towards the first bolt position. If desired, a protrusion and detent arrangement may be provided to resiliently hold the bolt 114 at one or more particular locations.

Figure 11A:
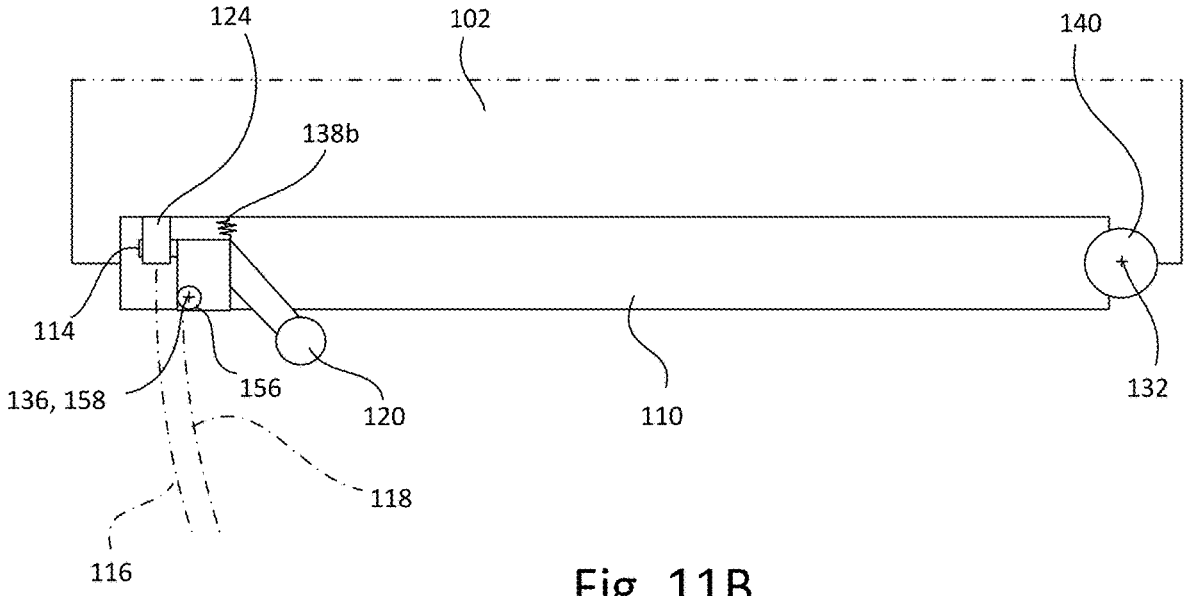
FIG. 11A schematically illustrates a top view of another laundry machine with the door in the closed position and the door latch assembly positioned with the bolt in the first bolt position.
Figure 11B:
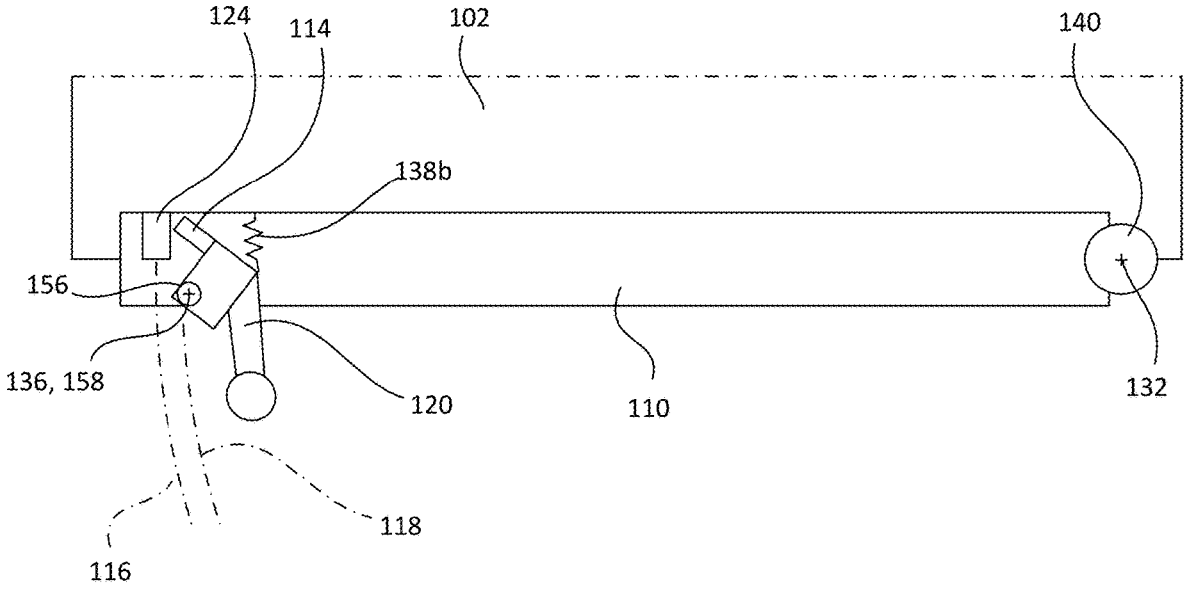
FIG. 11B schematically illustrates a top view of the laundry machine of FIG. 11A with the door in the open position with the door latch assembly positioned with the bolt in the second bolt position.

FIGS. 11A and 11B show another embodiment of a door latch assembly 112. In this case, the bolt handle 120 and bolt 114 are integrally formed as a single unit, and mounted to the door 110 by a bolt handle hinge 156. The bolt handle hinge 156 allows the bolt 114 and bolt handle 120 to rotate about a common rotation axis, which can be referred to as a bolt rotation axis 136 or a bolt handle rotation axis 158. A resilient member, such as a tension spring 138*b,* connects the bolt 114 and bolt handle 120 to the door 110 to provide an unlatching force that must be overcome to move the bolt 114 from the first bolt position to the second bolt position.

Figure 12A:
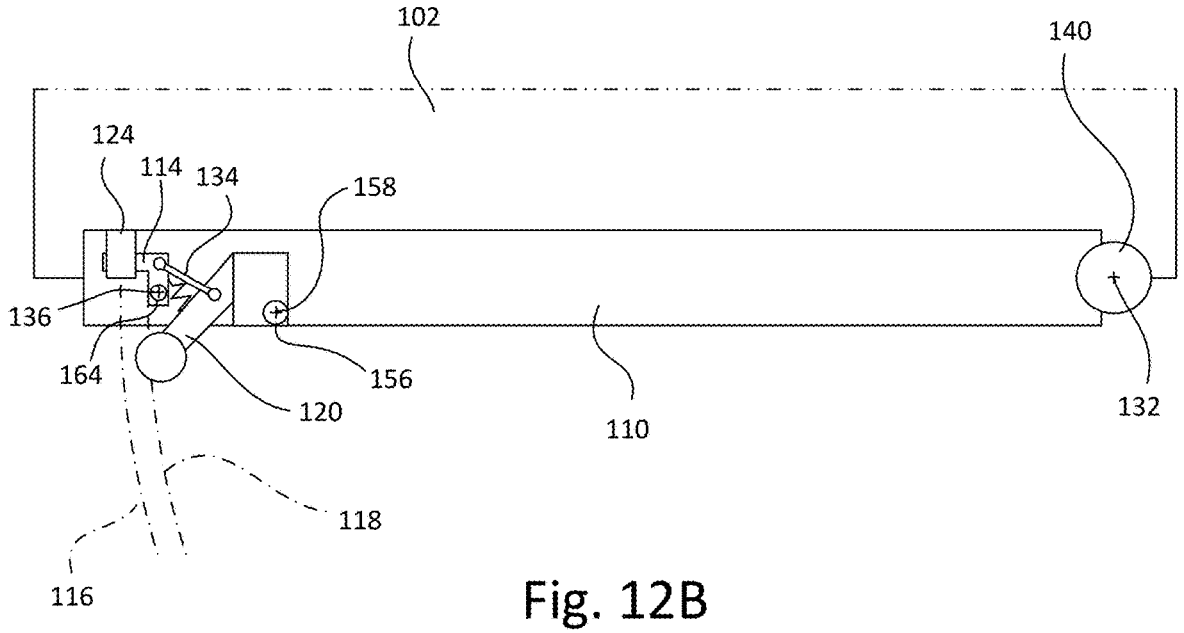
FIG. 12A schematically illustrates a top view of another laundry machine with the door in the closed position and the door latch assembly positioned with the bolt in the first bolt position.
Figure 12B:
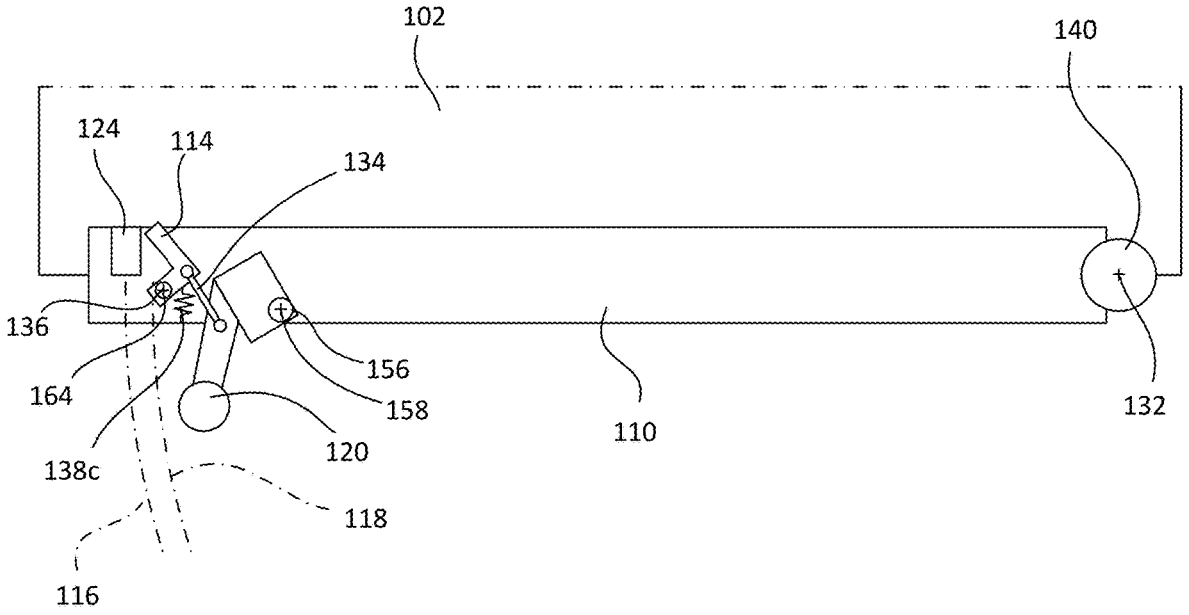
FIG. 12B schematically illustrates a top view of the laundry machine of FIG. 12A with the door in the open position with the door latch assembly positioned with the bolt in the second bolt position.

FIGS. 12A and 12B show another embodiment of a door latch assembly 112, in which the bolt 112 and the bolt handle 120 are separately pivotally connected to the door 110. The bolt 114 is mounted to the door 110 by a bolt hinge 164 to rotate about a bolt rotation axis 136, and the bolt handle 120 is mounted to the door 110 by a bolt handle hinge 156 to rotate about a bolt handle rotation axis 158. The bolt rotation axis 136 and bolt handle rotation axis 158 may be parallel to each other and to the door rotation axis 132, but neither parallel arrangement is strictly required. In this case, the bolt 114 is operatively connected to the bolt handle 120 by an intermediate linkage 134, such as the single link described previously, and operatively connected to the door 110 by a resilient member in the form of a compression spring 138*c* that generates an unlatching force that must be overcome to move the bolt 114 from the first bolt position to the second bolt position.

Figure 13A:
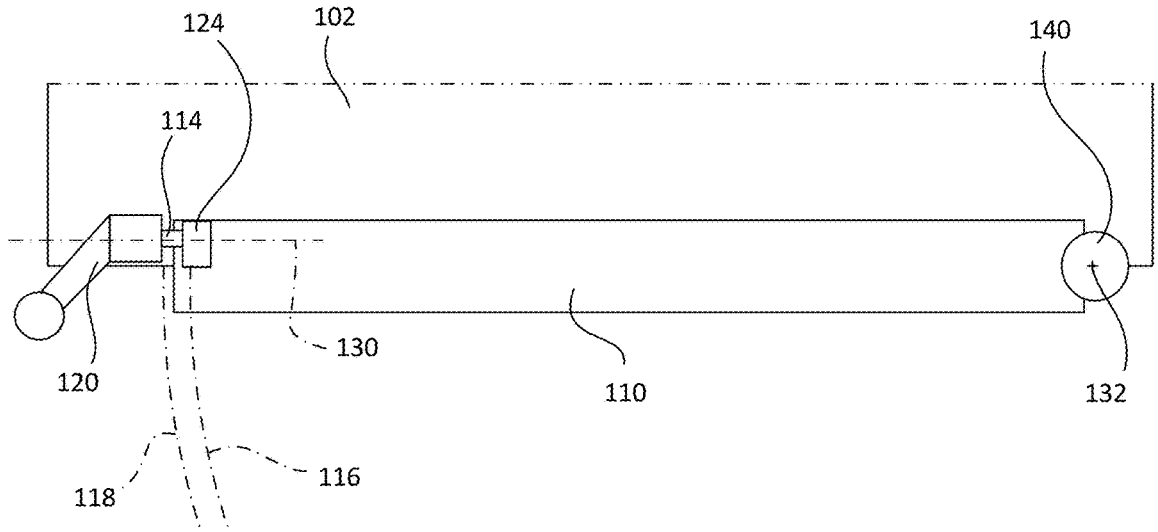
FIG. 13A schematically illustrates a top view of another laundry machine with the door in the closed position and the door latch assembly positioned with the bolt in the first bolt position.
Figure 13B:
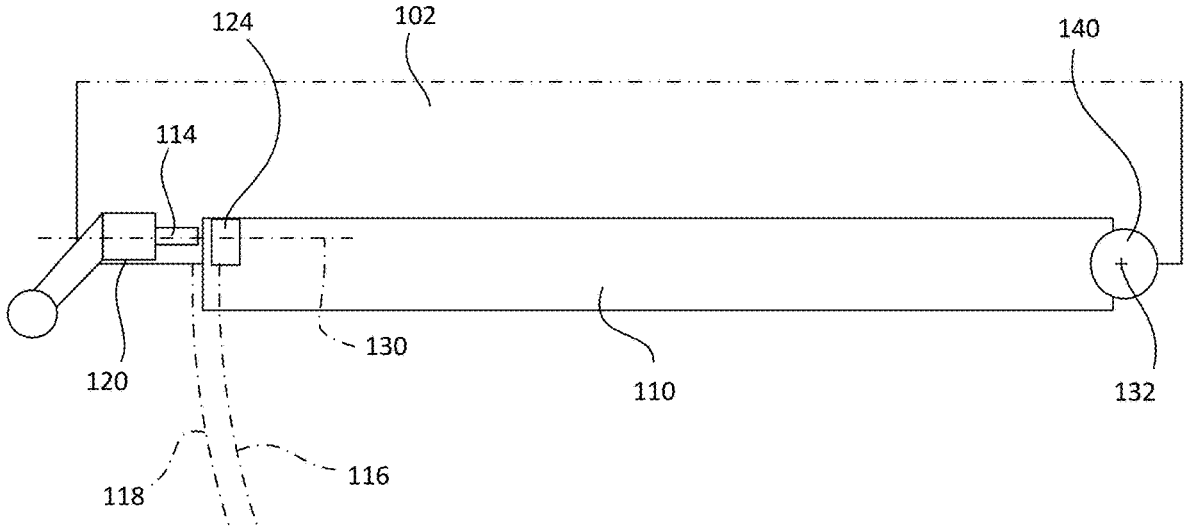
FIG. 13B schematically illustrates a top view of the laundry machine of FIG. 12A with the door in the open position with the door latch assembly positioned with the bolt in the second bolt position.

FIGS. 13A and 13B show another exemplary embodiment, in which the bolt 114 is mounted to the machine housing 102, and the catch 124 is mounted to the door 110. In this case, the first travel path 116 is located closer to the door rotation axis 132 than the second travel path 118. While the positions of the bolt 114 and catch 124 are reversed with respect to their mounting locations, their structure and operation can otherwise be the same as described above in relation to the embodiment of FIGS. 3A and 3B. Similarly, any of the other embodiments described herein may be reversed similarly to the embodiment of FIGS. 13A and 13B.

It will be appreciated from the foregoing that the bolt 114 and bolt handle 120 can have any number or variety of operative connections to the door 110 and to each other. It will also be appreciated that the foregoing embodiments may be modified by replacing features in one embodiment with features in another embodiment. For example, a compression spring 138*c* as shown in the embodiment of FIGS. 12A and 12B could be used in an embodiment otherwise constructed according to FIGS. 11A and 11B. Still further, it will be understood that the bolt 114 and bolt handle 120 may be mounted to the door 110 to have any number of respective movement paths, including linear paths, rotational paths, and variations thereof (e.g., movement along a complex curve via sliders or a four-bar linkage or the like). Other alternatives and variations will be apparent to persons of ordinary skill in the art in view of the present disclosure.

Embodiments such as those described herein can be configured to provide washing or drying machine door latch assemblies that can simultaneously satisfy internal force opening requirements to provide reliable operation and safety, and external force opening requirements to provide accessibility to users who might have limited ability to apply force to open the door from the outside. This is achieved by isolating, completely or to a large degree, the external force opening requirements from the internal force opening requirements. Thus, the internal force to open the door may be established at a relatively high magnitude (e.g., 9 pounds force or greater), while the external force to open the door may be established at a relatively low magnitude (e.g., 5 pounds force or less). Such embodiments can provide the full range of functionality without require an expensive electrical control system or the like. Furthermore, at least some embodiments may be configured to retrofit to existing door assemblies, either as a service kit or as a factory-installed option.

While embodiments may beneficially provide an external opening force that is less than the internal opening force, this is not strictly required in all cases. Embodiments may provide other advantages beyond the reduced comparative opening force. For example, an embodiment may beneficially provide a bolt handle that moves in a rotating path while the bolt moves in a linear path, or vice-versa. As another example, an intermediate linkage may be provided to redirect the operating direction of the bolt as compared to the bolt handle, to thereby provide greater flexibility to design the manner in which the user engages the door. These or other benefits may be realized in other embodiments, which may or may not also provide a reduced external opening force.

The present disclosure describes a number of inventive features and/or combinations of features that may be used alone or in combination with each other or in combination with other technologies. The embodiments described herein are all exemplary, and are not intended to limit the scope of the claims. It will also be appreciated that the inventions described herein can be modified and adapted in various ways, and all such modifications and adaptations are intended to be included in the scope of this disclosure and the appended claims.

The invention claimed is:

1. A laundry machine comprising:

a housing having an access opening;

a drum mounted within the housing and configured to rotate about a generally horizontal rotation axis, the drum comprising an open end located along the rotation axis and facing the access opening;

a door rotatably connected to the housing adjacent to the access opening, the door being movable between a closed door position in which the door closes the access opening, and an open door position in which the door does not close the access opening; and a door latch assembly comprising:

a bolt movable between a first bolt position and a second bolt position, wherein the first bolt position is located on a first travel path defined by movement of the door between the closed door position and the open door position, and the second bolt position is located on a second travel path defined by movement of the door between the closed door position and the open door position, a bolt handle having a grip portion that is accessible when the door is in the closed door position, the bolt handle being operatively connected to the bolt and configured to move the bolt from the first bolt position to the second bolt position, and a catch mounted within the first travel path and not within the second travel path, the catch being configured to engage the bolt when the door is in the closed door position and the bolt is in the first bolt position, wherein the catch and bolt are configured to exert an opening force opposing movement of the bolt along the first travel path upon movement of the door from the closed door position towards the open door position, the bolt maintains the first travel path when engaging the catch, wherein the bolt and the bolt handle are mounted to one of the door and the housing, and the catch is mounted to the other of the door and the housing.

2. The laundry machine of claim 1, wherein the laundry machine comprises a forced-air drying system.

3. The laundry machine of claim 1, wherein the bolt is mounted to move along a linear path between the first bolt position and the second bolt position.

4. The laundry machine of claim 3, wherein the linear path extends from the first bolt position towards a rotation axis of the door.

5. The laundry machine of claim 3, wherein the bolt is integrally formed with the bolt handle.

6. The laundry machine of claim 3, wherein the bolt is connected to the bolt handle by an intermediate linkage.

7. The laundry machine of claim 1, wherein the bolt is mounted to the door to move along a semicircular path about a bolt rotation axis between the first bolt position and the second bolt position.

8. The laundry machine of claim 7, wherein the bolt rotation axis is parallel to a rotation axis of the door.

9. The laundry machine of claim 7, wherein the bolt is integrally formed with the bolt handle.

10. The laundry machine of claim 7, wherein the bolt is connected to the bolt handle by an intermediate linkage.

11. The laundry machine of claim 1, wherein the catch is configured to exert a closing force opposing movement of the bolt along the first travel path upon movement of the door from the open door position to the closed door position.

12. The laundry machine of claim 11, wherein the closing force is equal to the opening force.

13. The laundry machine of claim 1, wherein the bolt is operatively connected to the door or the housing by a resilient member configured to exert an unlatching force opposing movement of the bolt from the first bolt position to the second bolt position.

14. The laundry machine of claim 13, wherein the resilient member comprises a spring positioned between the door or the housing and at least one of the bolt and the bolt handle.

15. The laundry machine of claim 14, wherein the spring is integrally formed with the bolt.

16. The laundry machine of claim 13, wherein the unlatching force is less than the opening force.

17. The laundry machine of claim 16, wherein the unlatching force is less than 5 pounds force, and the opening force is between 9 pounds force and 15 pounds force.

18. The laundry machine of claim 1, wherein:

the bolt comprises an entry face directed towards the closed door position and an exit face directed towards the open door position; and the catch comprises opposed leaf springs configured to be spread apart by the entry face upon movement of the door approaching the door closed position with the bolt in the first bolt position, and to move together to at least partially surround the exit face upon the door reaching the closed position with the bolt in the first bolt position.

19. The laundry machine of claim 18, wherein:

the entry face comprises an entry wedge that tapers towards the closed door position to an entry wedge tip; and the exit face comprises an exit wedge that tapers towards the open door position to an exit wedge tip.

20. The laundry machine of claim 19, wherein the entry wedge tapers at a first angle, the exit wedge tapers at a second angle, and the first angle equals the second angle.

21. The laundry machine of claim 1, wherein the bolt and the bolt handle are mounted to the door and the catch is mounted to the housing.

22. The laundry machine of claim 1, wherein the bolt and the bolt handle are mounted to the housing and the catch is mounted to the door.

* * * * *